United States Patent [19]

Even et al.

[11] Patent Number: 4,467,430

[45] Date of Patent: Aug. 21, 1984

[54] RAILWAY TRACK CIRCUIT

[75] Inventors: André Even, Coignieres; Christian Fortier, Egly; Michel G. Guillard, Villejûif; Dominique A. Hedoin, Sceaux; Serge D. Le Guen, Verrieres le Buisson; Dominique Raucourt, Longpont sur Orge; Christian H. Vendeventer, Plaisir, all of France

[73] Assignee: Compagnie de Signaux et d'Entreprises Electriques, Paris, France

[21] Appl. No.: 302,101

[22] Filed: Sep. 15, 1981

[30] Foreign Application Priority Data

Sep. 22, 1980 [FR] France ..... 80 20340

[51] Int. Cl.[3] ..... B61L 3/20; B61L 11/02; B61L 21/06

[52] U.S. Cl. ..... 364/436; 246/40; 246/122 R

[58] Field of Search ..... 364/436, 200, 900; 246/122 R, 40, 63 R

[56] References Cited

U.S. PATENT DOCUMENTS

| | | | |
|---|---|---|---|
| 3,610,920 | 10/1971 | Frielinghaus | 246/122 R |
| 3,663,809 | 5/1972 | Sibley | 246/40 |
| 3,888,437 | 6/1975 | Birkin | 246/122 R |
| 3,902,689 | 9/1975 | Hermann et al. | 246/122 R |
| 3,951,364 | 4/1976 | Sibley | 246/40 |
| 4,022,408 | 5/1977 | Staples | 246/40 |
| 4,046,342 | 9/1977 | Buzzard | 246/63 R |
| 4,151,969 | 5/1979 | Wood | 246/122 R |
| 4,166,599 | 9/1979 | Auer, Jr. et al. | 364/436 |
| 4,387,870 | 6/1983 | Matty et al. | 246/122 R |
| 4,392,625 | 7/1983 | Poupe | 246/63 R |

*Primary Examiner*—Felix D. Gruber
*Assistant Examiner*—Daniel K. Dorsey
*Attorney, Agent, or Firm*—Irvin A. Lavine

[57] ABSTRACT

A railway track comprising a pair of rails is divided into a succession of segments, each segment having a railway track circuit for separating successive trains. The track circuit is switchable between an initial state and a complementary state and comprises a downstream impedance electrically connecting the rails at a downstream point, an upstream impedance electrically connecting the rails at an upstream point, an electromagnetic sensor located between the upstream and downstream impedances in the vicinity of one of the rails, a transmitting member, and a pair of receiving members. One receiving member is in electromagnetic communication with the electromagnetic sensor. The transmitting member and the other receiving member are switchable between connection to the downstream impedance and the upstream impedance.

6 Claims, 5 Drawing Figures

RAILWAY TRACK CIRCUIT

BACKGROUND OF THE INVENTION

The present invention relates to a railway track circuit, formed by the two rails of a railway track portion and comprising a transmitting member connected to the downstream end of the circuit and a receiving member connected to the upstream end.

It is known that the safety and the regularity of trains running on railway tracks depend, among other conditions, on the distance separating two successive trains on the same track, taking into account the admissible speed with respect to the braking characteristics of the trains and the profile of the line.

The information required by the driver of the train for initiating actions for ensuring such safety and such regularity may be transmitted at fixed points of the route by lateral signals spaced out along the tracks. They may also, as a substitution for or as a reinforcement of the lateral signalling and when it is a question of automatic driving or of controlled manual driving, be transmitted directly at all points of the track to the locomotive.

Generally, at the present time, these are safety devices called "track circuits", which enable the information to be elaborated and transmitted required for the safety and the regularity of the traffic, not only in lateral signal systems but also in a number of systems using processes for transmitting information from the track to the locomotive.

In a way known per se, the track is divided into a succession of sections, each section being equipped with a track circuit. In the most general form, a track circuit is formed by a transmitting member and a receiving member, each situated at one end of the track circuit, and connected to the rails, so that a shunt axle between the transmitting point and the receiving point of the track causes the de-energization of a relay associated with the receiver. In the case of a track circuit associated with lateral signals, the relative position of the transmitter and of the receiver of the track circuit with respect to the entry and the exit of the section is immaterial, since only the presence or the absence of a shunt axle in the section counts. The same cannot be said in the case where the track circuit is used in a system with transmission of information from the track to the train. In such a system, the train receives the information by picking up the electromagnetic field radiated by the rails, which field exists because of the flow of signalling current in each of the lines of rails. The receiving member situated on board the train must then, on principle, be permanently located between the transmitting member and the first shunt axle of the train. It follows then obviously that in this case the transmitting member must always be connected to the downstream end of the track circuit, whereas the receiving member is connected to the upstream end.

In rail networks where the density of the traffic is one of the dominant elements, such as urban networks, the spacing signalling must be designed so that the distance separating two successive trains is minimized and that the time spent by trains in front of a closed signal is reduced as much as possible. It is therefore advantageous to be able to open the signal by activating the freeing, by the train occupying it, of a section situated downstream, while keeping between the signal to be opened and a critical point of the section being freed a free length of track corresponding to the maximum braking distance under the most unfavourable conditions. It is necessary, to achieve such anticipation, to know with all the required safety the position of the whole of the train with respect to both ends of the section which it occupies and/or with respect to the possible critical points.

Now, in the known systems of the prior art, the requirement of locating simultaneously the first shunt axle of the train (head of the train) and the last shunt axle of the train (tail end of the train) so as to know the relative position of the whole of the train with respect to both ends of the section and/or to a particular point leads to incompatibility between track circuit and transmission of information from the track to the locomotive.

SUMMARY OF THE INVENTION

The present invention has then as its principal object to remedy this disadvantage and for this it provides a track circuit of the above-mentioned type which is essentially characterized in that it further comprises at least one electromagnetic sensor disposed at a given position along the track circuit, a receiver associated with this sensor and switching means for switching the transmitting and receiving members of the track circuit, after the receiver associated with the sensor has been de-energized by the passage over said sensor of the first shunt axle carried by the train running on the track.

With this arrangement, it is possible, as will be clearly seen further on, to detect the passage of the last shunt axle of the train at a particular point of the track circuit given material form by the sensor, without for all that interrupting the transmission of information between the track and the locomotive, the detection of the last shunt axle resulting in the re-energization of the receiver associated with the sensor.

It appears however that such an arrangement may cause premature re-energization of said receiver, in the case where the distance existing between two adjacent axles of the train is greater than the distance separating the sensor from the upstream end of the track circuit where the transmitter is connected.

To remedy this situation, the track circuit, assumed to be of the type with electric separation joints, i.e. without insulating joints, comprises a second sensor disposed upstream of the first one and beyond the corresponding end of the track circuit, at a distance therefrom greater than the maximum distance existing between two adjacent shunt axles of the trains likely to run on the track, this second sensor being associated with a receiver responsive to the operating frequency of the track circuit considered.

Thus, the anticipated freeing information, corresponding to detection of the last shunt axis, will only be delivered when the receivers associated with both sensors are simultaneously de-energized.

Preferably, the second sensor is implanted in the median zone of the electric separation joint and it is associated with a second receiver responsive to the operating frequency of the track circuit situated upstream.

It is thus possible to take advantage of the presence of this second sensor to accurately determine the position of the "imaginary joint" at the entry to the track circuit and to check the freeing of the whole zone occupied by the joint.

According to another characteristic of the invention, the track circuit comprises an additional transmitting member which is connected in place of the receiving member as soon as the receiver associated with the sensor is de-energized, whereas the original transmitting member remains connected to the downstream end of the track circuit.

With such an arrangement, it is still possible to detect the last axle, even in the case of very short trains or of very long track circuits. In the absence of an additional transmitting member, it is in fact necessary, so as not to interrupt the transmission of information between the track and the locomotive, to switch the transmitting and receiving members only when the first axle has gone beyond the downstream end of the track circuit considered. Now, it may happen that at this time the last axle has already passed over the sensor, if the distance which separates the sensor from the downstream end of the track circuit is greater than the length of the train.

According to yet another feature of the invention, several electromagnetic sensors, each associated with a receiver, are spaced apart along the track circuit, the original transmitting member being connected successively in time, immediately downstream of the different sensors, then to the downstream end of the track circuit, as the train advances progressively in said track circuit.

It is thus possible to detect simultaneously the first axle and the last axle of the train, while improving the conditions for transmitting information between the track and the locomotive, since the distance between the head of the train and the transmitter is reduced.

BRIEF DESCRIPTION OF THE DRAWINGS

Several embodiments of the invention are described below by way of examples, with reference to the accompanying drawings in which.

DESCRIPTION OF THE PREFERRED EMBODIMENTS

Figure 1:
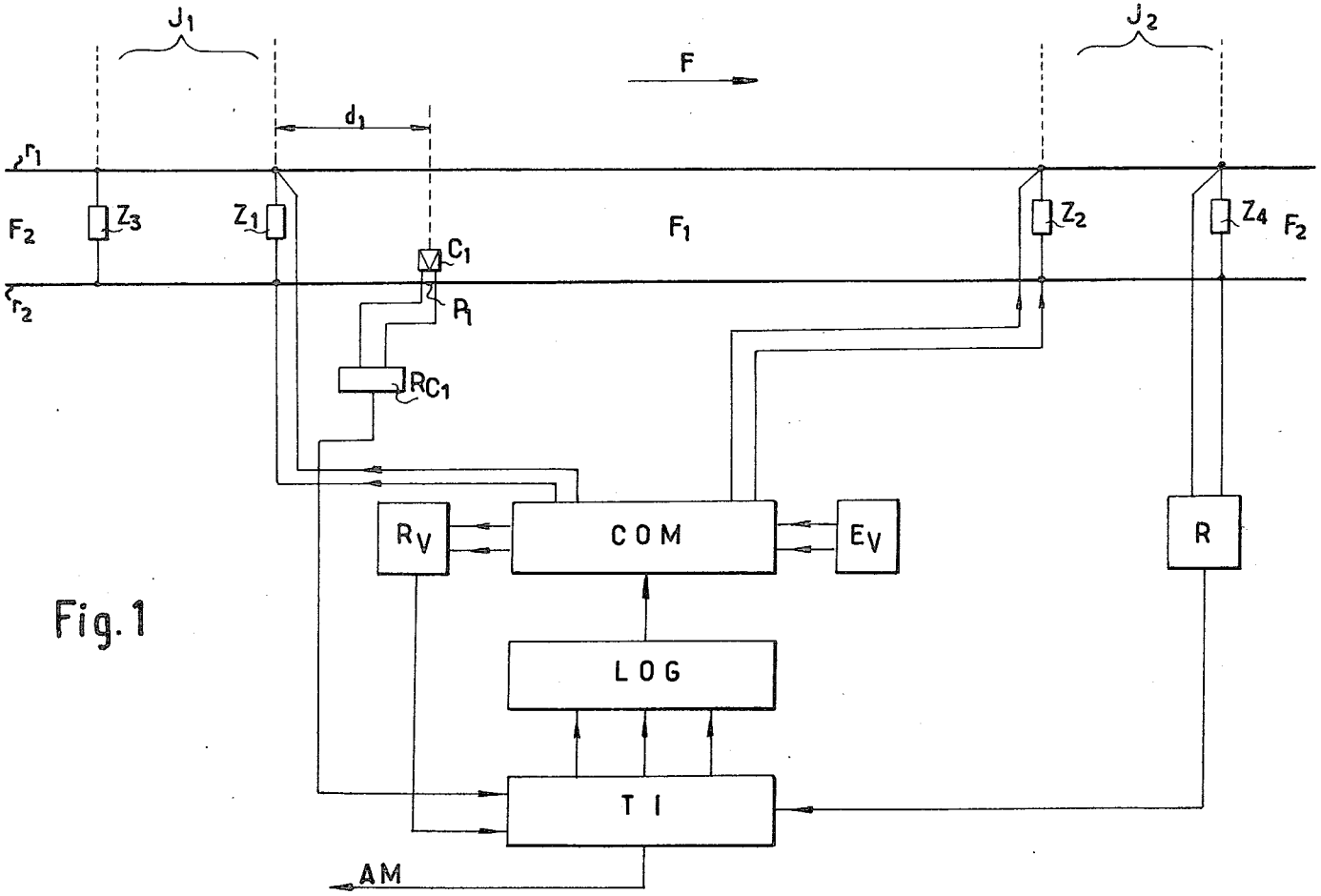
FIG. 1 is a simplified diagram of a track circuit equipped in accordance with the invention.

The track circuit shown in FIG. 1 is of the type with electric separation joints, also known under the name of jointless track circuit, i.e. without insulating joints. It is essentially formed by the two lines of rails $r_1$ and $r_2$ of a railway track portion bounded by two electric separation joints $J_1$ and $J_2$. These joints are given respectively material form by the impedances $Z_3$, $Z_1$ and $Z_2$, $Z_4$. It will be further assumed that the trains move over the track in the direction shown by arrow F.

In a way known per se, the signalling current flowing in the track circuit thus defined is at a first frequency $F_1$, whereas the signalling current flowing in the track circuits situated respectively upstream and downstream of the track circuit considered is at a second frequency $F_2$ different from $F_1$. This signalling current at frequency $F_1$ is generated by a transmitting member $E_V$ which is normally connected to the downstream end of the track circuit, i.e. to the terminals of impedance $Z_2$. In the absence of a shunt axle on the track circuit considered, this transmitting member $E_V$ enables a receiving member $R_V$ to be energized which is responsive to the frequency $F_1$ and which is normally connected to the upstream end of the circuit, i.e. to the terminals of impedance $Z_1$.

In accordance with the invention, the track circuit further comprises an electromagnetic sensor $C_1$, placed on the ground in the vicinity of one or other of the two lines of rails $r_1$ and $r_2$, at a point $P_1$ of the circuit situated at a distance $d_1$ from impedance $Z_1$. This sensor $C_1$, which may be of any known type, enables the surrounding field due to the signalling current flowing in rails $r_1$, $r_2$ to be transformed into a voltage of the same frequency and with an amplitude proportional to the intensity of this current. It is then associated with a receiver $R_{C1}$ responsive to the frequency $F_1$ of the track circuit considered.

A switching device or switch COM is moreover provided for reversing the position with respect to the track of transmitter $E_V$ and of receiver $R_V$. In other words, depending on the state of the switching device, receiver $R_V$ may be met at the upstream end of the circuit (connected to the terminals of impedance $Z_1$) and transmitter $E_V$ at the downstream end of the circuit (connected to the terminals of impedance $Z_2$) or conversely. Switching device COM is controlled by switching logic LOG itself receiving the orders from a device for processing the information TI which centralizes the information coming from the different reception points disposed along the track circuit. In this case, it is a question of information coming respectively from the track circuit receiver $R_V$, from receiver $R_{C1}$ associated with sensor $C_1$ and from a receiver R responsive to the frequency $F_2$ which is connected to the terminal of impedance $Z_4$ forming the upstream end of the track circuit situated downstream of the track circuit considered.

The track circuit which has just been described operates in the following way.

At the outset, the track circuit is in its initial state defined by a position of switch COM such that receiver $R_V$ is connected to the terminals of impedance $Z_1$ and transmitter $E_V$ to the terminals of impedance $Z_2$. Furthermore, no shunt axle is on the track portion considered, so that receivers $R_V$, $R_{C1}$ and R are all three energized.

Let us now assume that a train moves over the track, in the direction shown by arrow F, from the track circuit situated upstream towards the track circuit situated downstream, by passing over the track circuit considered. When the first shunt axle of the train penetrates into the input joint $J_1$, and for a variable position thereof inside said joint, receiver $R_V$ connected to the terminals of impedance $Z_1$ is de-energized. Then, when the first shunt axle crosses point $P_1$ where sensor $C_1$ is implanted, the associated receiver $R_{C1}$ is de-energized in its turn because of the shunting of all or part of the signalling current generated by transmitter $E_V$.

Finally, the first shunt axle of the train penetrates into the output joint $J_2$ and causes de-energization of receiver R. At that moment, the device for treating the information TI causes, through the switching logic LOG, switch COM to pass from its initial state to its complementary state, transmitter $E_V$ being thenceforth connected to the terminals of impedance $Z_1$ whereas receiver $R_V$ will be connected to the terminals of impedance $Z_2$. It is then obvious that receiver $R_V$ will be de-energized, confirming the new state of the circuit, and that receiver $R_{C1}$ will be re-energized as soon as the last shunt axle of the train has, in its turn, crossed point $P_1$ since transmitter $E_V$ will then inject the signalling current at the rear of the train. Thus information is available corresponding to the detection of the passage of the last shunt axle of the train at a point $P_1$ of the track circuit.

It will further be noted that with such an arrangement, the transmission of information between the track and the locomotive is never interrupted. In fact, at the time when transmitter $E_V$ is switched, the receiver on-board the train is already receiving the information required from the transmitter which equips the downstream track circuit.

The freeing of the zone formed by electric joint $J_1$ and the track portion "$d_1$" between impedance $Z_1$ and point $P_1$ allows, as illustrated in the figure by the connection AM, working information to be delivered to the signalling equipment situated downstream of the track circuit, allowing for example anticipated opening of the upstream signals as soon as the rear axle of the train has crossed this point $P_1$, the distance "$d_1$" being considered as a maximum for example with respect to the braking characteristics of the trains running on the track. The return of the whole of the track circuit to its initial state will be initiated by re-energization of receiver $R_V$, this re-energization being obtained when the last shunt axle of the train has moved sufficiently downstream of impedance $Z_2$ from the output joint $J_2$ of the track circuit.

Figure 2:
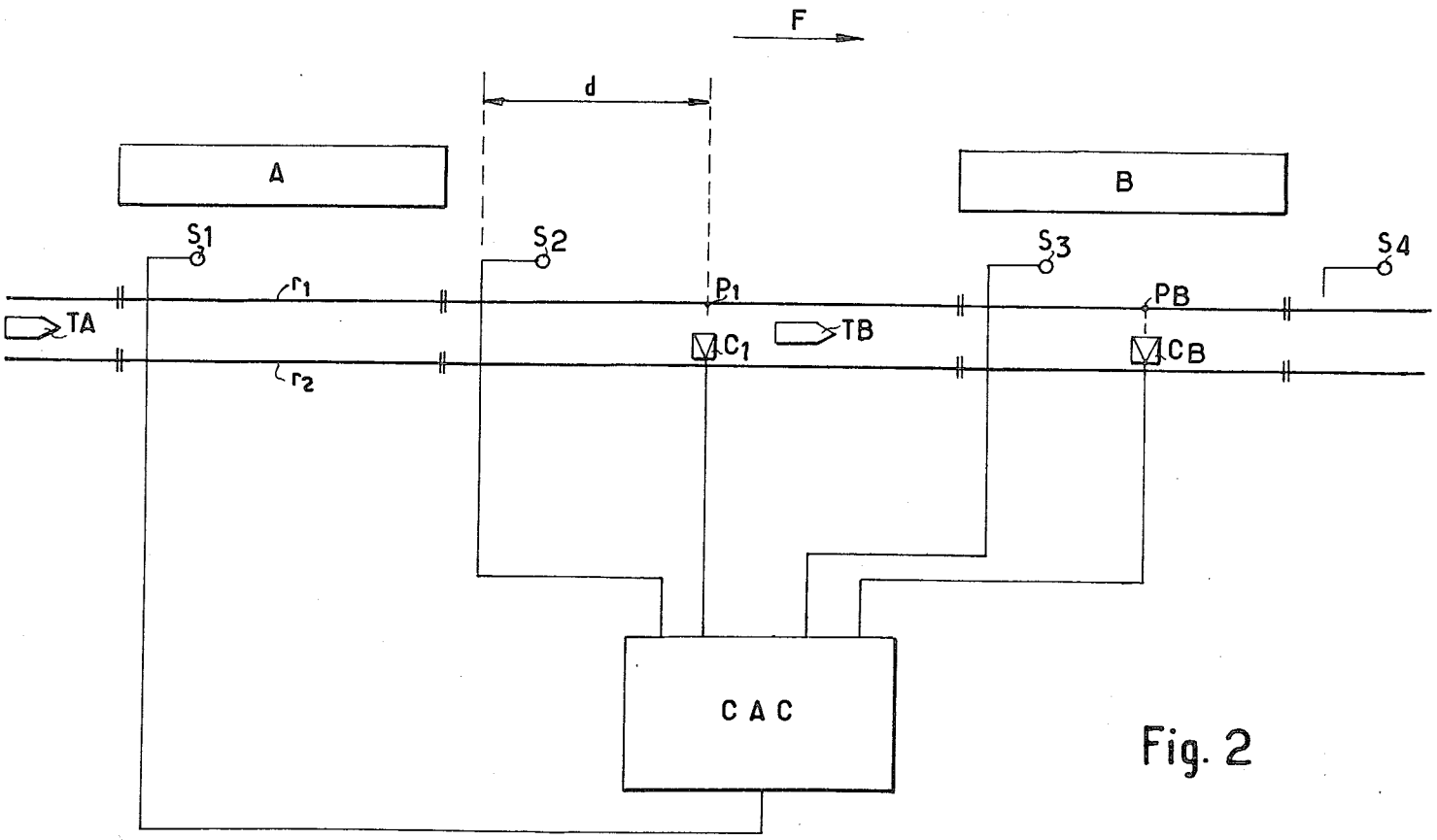
FIG. 2 is a simplified diagram illustrating one application of the invention to the operation of a rail network postion comprising successive stations.

Referring now to FIG. 2, an example of application of the invention will be described to a running problem related to a network in which the traffic density and, consequently, the limitation to as short a time as possible of the time spent by trains in front of a closed signal, is the dominant element. Let us assume a network comprising, in particular, two stations A and B. The entrance to the station A is protected by an entrance signal $S_1$, and its exit, by an exit signal $S_2$. Similarly, the entry of station B is protected by an entry signal $S_3$, whereas its exit is protected by a signal $S_4$.

The track circuits of the rail network portion considered are naturally equipped in accordance with the invention. Thus, more especially, the track circuit separating the exit of station A (signal $S_2$) from the entry of station B (signal $S_3$) comprises a sensor $C_1$ at a point $P_1$, and the platform track circuit of station B comprises a sensor $C_B$ at a point $P_B$.

In conventional working, with a buffer section, signal $S_1$ can only be unblocked when the interstation section is entirely freed. Thenceforth, a train $T_A$ can only have access to the platform of station A when the preceding train $T_B$ has completely freed the track circuit between the two signals $S_2$ and $S_3$. The use of track circuits in accordance with the invention allows signal $S_1$ to be prematurely unblocked, as soon as the last shunt axle of the train has freed track portion d between the exit signal $S_2$ and point $P_1$ where sensor $C_1$ is implanted, allowing train $T_A$ to have access to the platform of the downstream station (interstation circuit). Similarly, as soon as train $T_B$ has freed the track portion between the entry signal $S_3$ of station B and point $P_B$, train $T_A$ may leave station A before the platform of station B has been completely freed by train $T_B$. All these operations are carried out automatically, by means of an automatic switching control system CAC connected to the different elements of the network.

Figure 3:
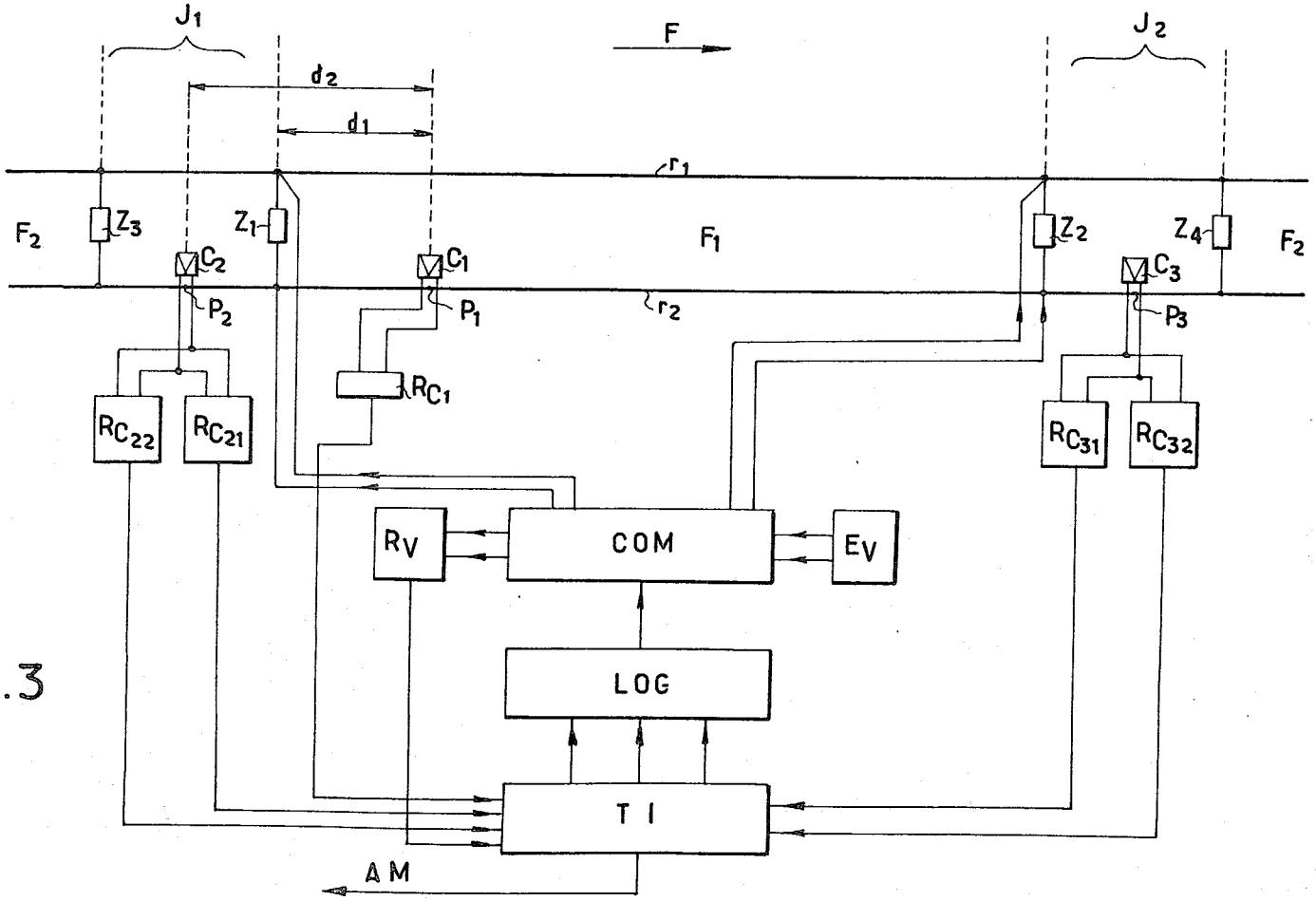
FIG. 3 is a simplified diagram of a first variation of the invention.

It is however obvious that an arrangement such as that described in connection with FIG. 1 may cause premature re-energization of receiver $R_{C1}$ if the distance "$d_1$" is less than the distance existing between two adjacent axles of the train. The simplified diagram of FIG. 3, in which all the elements of FIG. 1 are taken up again, shows a variation of the invention precisely for palliating such a situation, because of the use of an additional sensor $C_2$ implanted at a point $P_2$ situated upstream so that the distance "$d_2$" separating sensor $C_2$ from sensor $C_1$ is greater than the maximum length existing between two adjacent axles on trains running over the network. With this sensor $C_2$ are associated receivers $R_{C22}$ and $R_{C21}$ responsive, one to the frequency $F_2$ of the upstream track circuit, the other to the frequency $F_1$ of the track circuit. The anticipated freeing information will then be delivered when all three receivers $R_{C1}$, $R_{C21}$, $R_{C22}$ are re-energized.

Preferably, sensor $C_2$ is implanted in the middle of joint $J_1$. It then enables, with its associated receivers, the position of the "imaginary joint" at the entry to the track circuit defined by electric joints $J_1$ and $J_2$ to be precisely located and the freeing of the whole of the upstream joint $J_1$ to be checked. In fact, when the first shunt axle of the train penetrates into joint $J_1$, it begins by de-energizing receiver $R_{C22}$, then receiver $R_{C21}$ as soon as it has crossed over point $P_2$, thus accurately defining the position of the imaginary joint marking the entry of the track circuit considered.

For reasons of symmetry, a sensor $C_3$, associated with a receiver $R_{C31}$ responsive to the frequency $F_1$ and a receiver $R_{C32}$ responsive to the frequency $F_2$ is implanted at a point $P_3$ of joint $J_2$, for controlling the return of switch COM to its initial state when the whole of joint $J_2$ has been freed by the last shunt axle of the train.

Advantageously, receivers $R_{C21}$ and $R_{C32}$ may be substituted for the receivers of the track circuits concerned, normally connected to the terminals of impedances $Z_1$ and $Z_4$.

In the embodiment of the invention shown in FIG. 1, it was seen that the switching between the transmitting and receiving members was only carried out when the first shunt axle of the train penetrated into the exit joint $J_2$, so as not to interrupt the transmission of information between the track and the locomotive. Now, it may happen that at this moment the last shunt axle of the train has already passed beyond the point $P_1$ where sensor $C_1$ is implanted, either because it is a very short train, or else because the distance separating the sensor from the downstream end of the track circuit is quite simply greater than the length of the train. The proper operation of the system involves accordingly special implantation of sensor $C_1$ depending on the minimum length of the trains running on the track.

Figure 4:
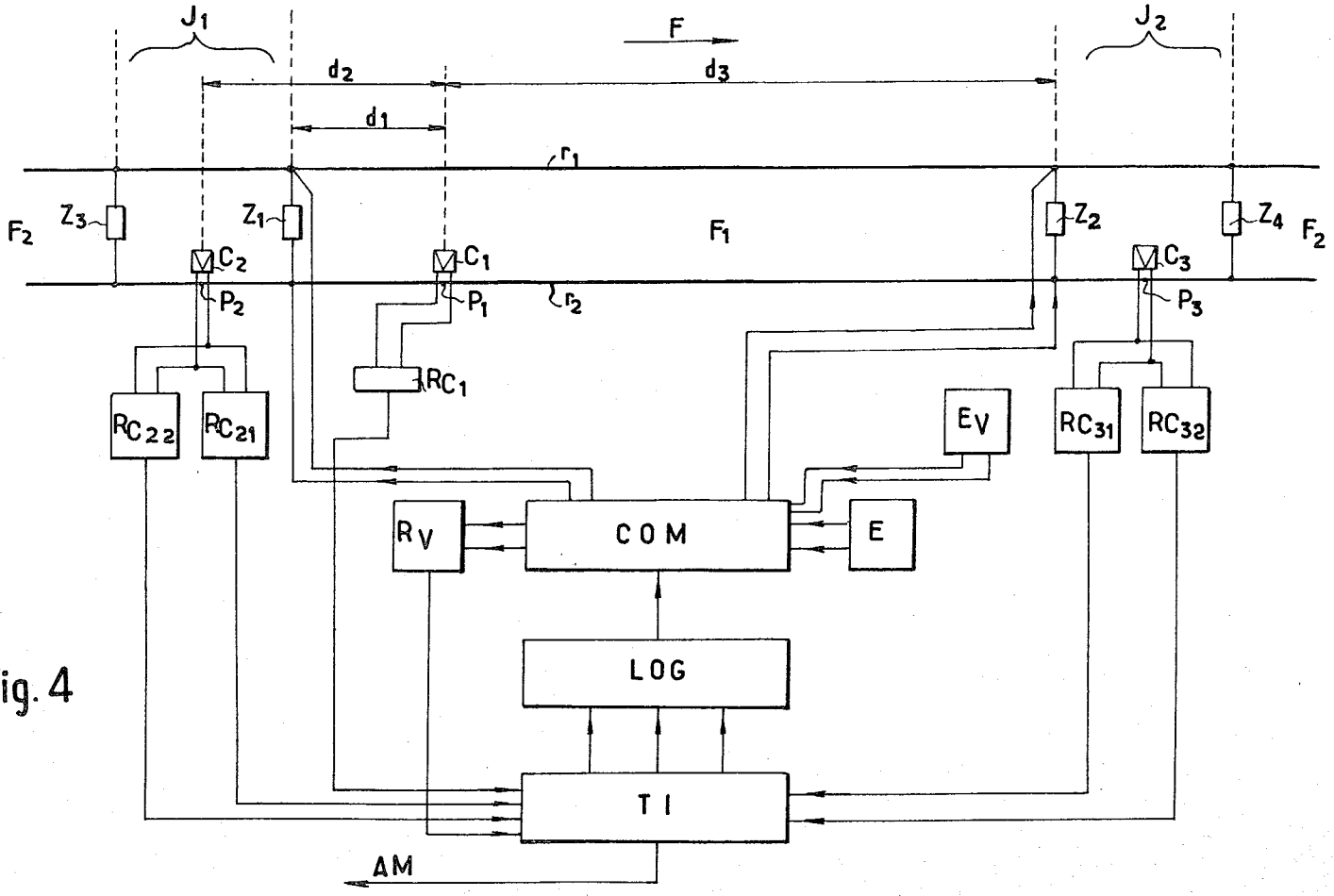
FIG. 4 is a simplified diagram of a second variation of the invention.

The variation of the invention shown in FIG. 4, in which the elements of FIG. 3 are taken up again, enables precisely this drawback to be remedied, because of the addition of an additional transmitting member E. The switching in accordance with the invention between the transmitting and receiving members is then carried out in a first step between receiver $R_V$ and the additional transmitter E, as soon as the receiver $R_{C1}$ associated with sensor $C_1$ is de-energized, whereas transmitter $E_V$ remains connected to the terminals of impedance $Z_2$ and may thus continue to transmit information from the track to the locomotive. It will furthermore be noted that the additional transmitter E may simply consist of a device of a known type for picking up a part of the energy available at the output of transmitter $E_V$ and injecting it into the terminals of impedance $Z_1$ under conditions detemined by the state of switch COM.

The thus-defined state of the switching logic LOG and of switch COM constitutes, for the information processing device TI, memorization of the occupation of the track circuit although, because of the simultaneous presence of both transmitters $E_V$ and E, receivers $R_{C22}$, $R_{C21}$, $R_{C1}$, $R_{C31}$, $R_{C32}$ may be energized at the same time provided that the length of the train occupying the track circuit is less than distance $d_3$ separating point $P_1$ where sensor $C_1$ is implanted from the downstream end of the track circuit formed by impedance $Z_2$.

This memorization will be cancelled out when, with the first axle of the train crossing the point where impedance $Z_2$ is implanted to the terminals of which transmitter $E_V$ is connected, receiver $R_{C31}$ is de-energized. In the second step, the switching logic LOG will then cause disconnection of the additional transmitter E and the connection in place of this transmitter (i.e. to the terminals of impedance $Z_1$) of transmitter $E_V$, whose presence is no longer required downstream of the track circuit since the head of the train has already crossed the corresponding end of the track circuit. Thus conflict is avoided between the signals from both transmitters E and $E_V$ during freeing of section $Z_1$-$Z_2$ by the last axle of the train, while maintaining the permanence of information relating to the presence of the last axle of the train upstream of point $P_1$ which, as has been seen, requires the presence of a transmitter at the upstream end of the track circuit.

The return of the device to the initial state will be initiated by re-energization of receiver $R_{C31}$ which will take place when the last axle of the train has passed beyond point $P_3$, thus freeing the track circuit.

Figure 5:
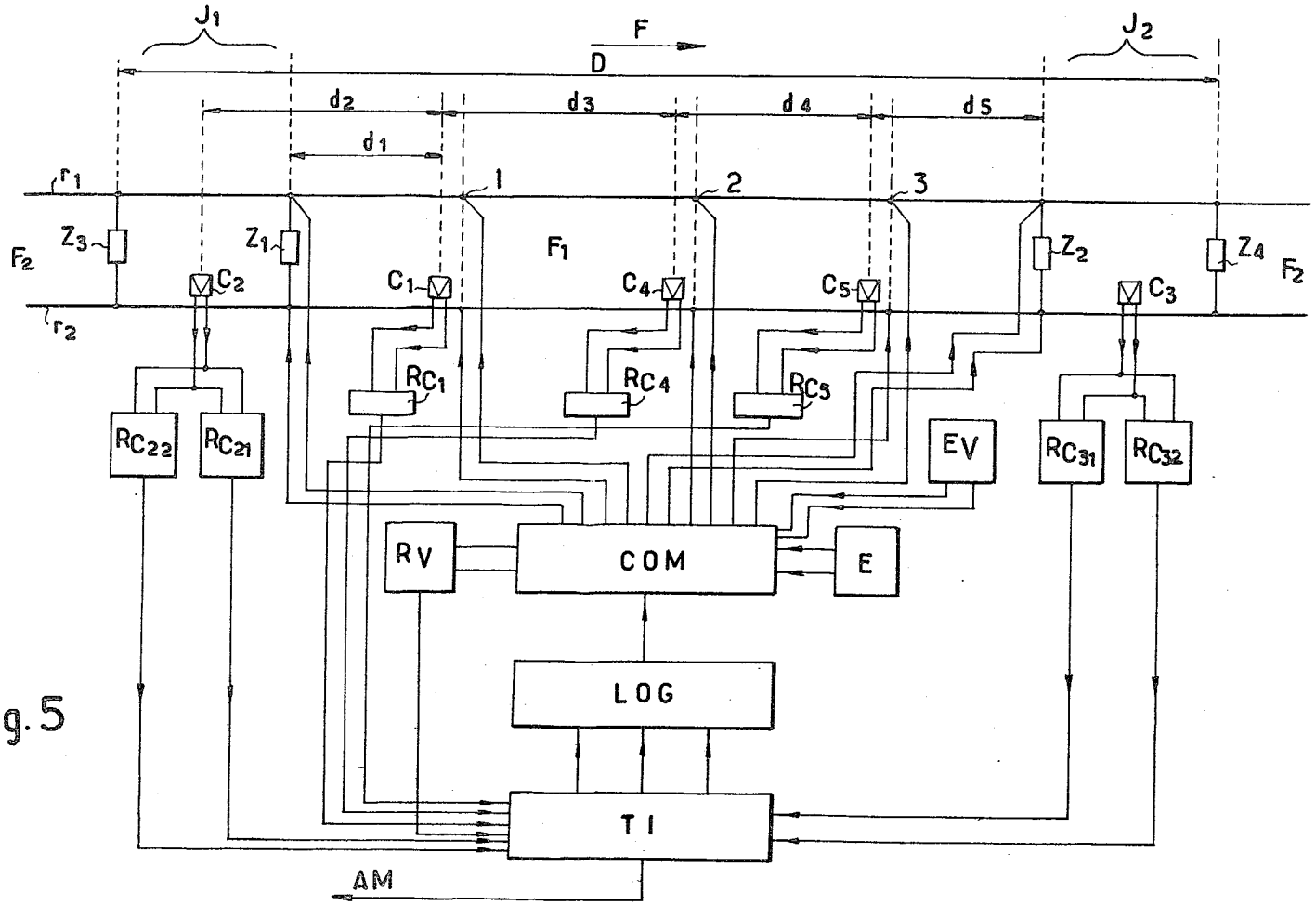
FIG. 5 is a simplified diagram of a third variation of the invention.

The simplified diagram of FIG. 5 shows another variation of the invention in which several successive sensors are used such as $C_1$, $C_4$, $C_5$, spread out along the track circuit considered, each of these sensors being associated with a receiver responsive to the frequency $F_1$, respectively $R_{C1}$, $R_{C4}$ and $R_{C5}$. In this variation, which naturally takes up again all the elements of FIG. 4 with the corresponding operating mode, transmitter $E_V$ is successively connected in time and immediately downstream of the different sensors, either to points 1, 2, 3 then to the terminals of impedance $Z_2$, as the train progresses in the section. It obviously follows therefrom that the receivers associated with each of these sensors is successively deenergized as the first shunt axle of the train is inserted between the transmitter $E_V$ and the sensor concerned.

Such an arrangement may more especially be used for detecting simultaneously the presence of the first axle and of the last axle of the train inside the track circuit, and so for locating geographically the train on this track circuit. This arrangement may also, in particular in the case of track circuits of great length, improve if necessary the conditions of transmission of information from the track to the locomotive by reducing the length of the track existing between the transmitter $E_V$ which generates the information to be transmitted and the head of the train which receives this information.

We claim:

1. A railway track circuit for separating first and second successive trains having a front shunt axle at the front and a rear shunt axle at the rear and travelling in the same direction on a track comprising a plurality of track circuits, each said track circuit being switchable between an initial state in the absence of a shunt axle on said track circuit and a complementary state upon passage of a front shunt axle out of said track circuit and comprising:

a pair of rail segments, said rail segments having a downstream end, towards which the trains are travelling, and an upstream end, away from which the trains are travelling, downstream impedance means electrically connecting said rails at a downstream point and defining the downstream end of said track circuit, upstream impedance means electrically connecting said rails at an upstream point and defining the upstream end of said track circuit, a transmitting member electrically connected to said downstream impedance means when said track circuit is in said initial state and to said upstream impedance means when said track circuit is in said complementary state, a first track circuit receiving member electrically connected to said upstream impedance means when said track circuit is in said initial state and to said downstream impedance means when said track circuit is in said complementary state, at least one track circuit electromagnetic sensor located between said upstream and said downstream impedance means in the vicinity of one of said rails for detecting passage of the front and rear shunt axles of the trains over said rails, a second track circuit receiving member in electromagnetic communication with said at least one track circuit electromagnetic sensor, switchable between energized and de-energized states, and adapted to be switched to said de-energized state upon detection of the passage of the front shunt axle of the first train by said at least one track circuit electromagnetic sensor, and switching means electrically connected to said transmitting member and said first track circuit receiving member for reversing the electrical connections between said first track circuit receiving member, said transmitting member, and said upstream and downstream impedance means.

2. The railway track circuit of claim 1, wherein said upstream impedance means defines the downstream end of a separation joint separating said track circuit from another track circuit immediately upstream thereof, and further comprising:

an upstream electromagnetic sensor located in said separation joint, the distance between said upstream electromagnetic sensor and said at least one track circuit electromagnetic sensor being greater than the maximum distance between adjacent axles on a train, and an upstream receiving member electrically connected to said upstream electromagnetic sensor and responsive to the operating frequency of the current flowing through said track circuit.

3. The railway track circuit of claim 2, further comprising another upstream receiving member electrically connected to said upstream electromagnetic sensor and responsive to the operating frequency of the current flowing through the track upstream of said track circuit.

4. The railway track circuit of claim 1, 2, or 3, wherein said track circuit additionally has an intermediate state between said initial and said complementary states in the presence of a front shunt axle between said track circuit electromagnetic sensor and said downstream impedance means, and wherein both said transmitting member and said first track circuit receiving member are electrically connected to said downstream impedance means when said track circuit is in said intermediate state and further comprising:

another transmitting member electrically connected to said downstream impedance means when said track circuit is in said initial state and said upstream impedance means when said track circuit is in said intermediate state.

5. The track circuit of claim 4, further comprising:

three spaced-apart track circuit electromagnetic sensors, and three second receiving members, each associated with a respective one of said three track circuit electromagnetic sensors, and wherein said transmitting member is electrically connected successively in time to said rails immediately downstream of each of said track circuit electromagnetic sensors when said track circuit is in said intermediate state.

6. A railway track circuit for separating first and second successive trains having a front shunt axle at the front and a rear shunt axle at the rear and travelling in the same direction on a track comprising a plurality of track circuits, said track circuit being switchable between an initial state in the absence of a shunt axle on said track circuit and a complementary state upon passage of a shunt axle out of said track circuit and comprising:

a pair of rail segments, said rail segments having a downstream end, towards which the trains are travelling, and an upstream end, away from which the trains are travelling, means for creating an impedance between said rails at a downstream point, means for creating an impedance between said rails at an upstream point, means for generating a signalling current in said track circuit at a first frequency when said track circuit is in said initial state, means for transforming the electromagnetic field due to the signalling current into a voltage having the same frequency as and an amplitude proportional to the intensity of the signalling current, means for generating a current in the track upstream and downstream of said track circuit at a second frequency, first means for generating information regarding passage of a train connected to said downstream impedance creating means when said track circuit is in said initial state and responsive to said first frequency, second means for generating information regarding passage of a train connected to said transforming means and responsive to said first frequency, third means for generating information regarding passage of a train connected to another track circuit adjacent to and downstream of said track circuit and responsive to said second frequency, means responsive to the information generated by said first, second, and third information generating means for reversing the connection with respect to said upstream and downstream impedance creating means of said signalling current generating means and said first information generating means.

* * * * *